US010641107B2

(12) United States Patent
Coull et al.

(10) Patent No.: US 10,641,107 B2
(45) Date of Patent: May 5, 2020

(54) TURBINE BLADE WITH TIP OVERHANG ALONG SUCTION SIDE

(71) Applicants: ROLLS-ROYCE PLC, London (GB); ROLLS-ROYCE DEUTSCHLAND LTD & CO KG, Dahlewitz (DE)

(72) Inventors: John David Coull, Cambridge (GB); Nicholas Robert Atkins, Cambridge (GB); Howard Peter Hodson, Cambridge (GB); Adrian James White, Derby (GB); Knut Lehmann, Dahlewitz (DE); Manuel Herm, Dahlewitz (DE)

(73) Assignees: ROLLS-ROYCE plc, London (GB); ROLLS-ROYCE DEUTSCHLAND LTD & CO KG, Dahlewitz (DE)

( * ) Notice: Subject to any disclaimer, the term of this patent is extended or adjusted under 35 U.S.C. 154(b) by 1654 days.

(21) Appl. No.: 14/062,230

(22) Filed: Oct. 24, 2013

(65) Prior Publication Data

US 2014/0119920 A1 May 1, 2014

(30) Foreign Application Priority Data

Oct. 26, 2012 (GB) ..... 1219267.0
Oct. 31, 2012 (DE) ..... 10 2012 021 400

(51) Int. Cl.
*F01D 5/20* (2006.01)
*F01D 5/14* (2006.01)
*F01D 11/08* (2006.01)

(52) U.S. Cl.
CPC ..... *F01D 5/20* (2013.01); *F01D 5/141* (2013.01); *F01D 11/08* (2013.01); *F05D 2240/307* (2013.01)

(58) Field of Classification Search
CPC ... F01D 5/20; F01D 5/187; F01D 5/18; F01D 5/186; F01D 5/141; F01D 5/147; F01D 11/08; F05D 2250/712; F05D 2240/307
See application file for complete search history.

(56) References Cited

U.S. PATENT DOCUMENTS 711,832 A 10/1902 Denison
1,955,929 A * 4/1934 Mueller ..... F03B 3/126 415/132

(Continued)

FOREIGN PATENT DOCUMENTS

CN 101255800 A 9/2008
CN 101255873 A 9/2008

(Continued)

OTHER PUBLICATIONS

Nov. 19, 2013 Search Report issued in European Patent Application No. 13 19 0022 (w/ translation).

(Continued)

*Primary Examiner* — Kenneth Bomberg
*Assistant Examiner* — Julian B Getachew
(74) *Attorney, Agent, or Firm* — Oliff PLC

(57) ABSTRACT

A turbine blade has a root portion, a platform and an aerofoil, the aerofoil is mounted on the platform and is formed by a pressure side wall and a suction side wall and has an outer surface, the pressure side wall and the suction side wall meet at a leading edge and a trailing edge, the aerofoil has an axial chord length, the suction side wall defines part of the radially outward surface of the aerofoil, the suction side wall defines an overhang, the overhang has a maximum overhang length that is between 5% and 20% of the axial chord length of the blade and is located between 5% and 50% of the suction surface length from the leading edge.

6 Claims, 8 Drawing Sheets

(56) References Cited

U.S. PATENT DOCUMENTS

| | | | | |
|---|---|---|---|---|
| 4,424,001 | A | 1/1984 | North et al. | |
| 4,761,116 | A | 8/1988 | Braddy et al. | |
| 5,503,527 | A | 4/1996 | Lee et al. | |
| 6,142,739 | A | 11/2000 | Harvey | |
| 6,422,821 | B1 | 7/2002 | Lee et al. | |
| 7,118,329 | B2 | 10/2006 | Goodman | |
| 7,351,035 | B2 * | 4/2008 | Deschamps | F01D 5/20 416/92 |
| 7,632,062 | B2 | 12/2009 | Harvey et al. | |
| 7,641,446 | B2 * | 1/2010 | Harvey | F01D 5/141 415/173.1 |
| 7,740,445 | B1 * | 6/2010 | Liang | F01D 5/187 415/173.5 |
| 8,133,032 | B2 | 3/2012 | Tibbott et al. | |
| 8,246,307 | B2 | 8/2012 | Cheong et al. | |
| 8,632,311 | B2 | 1/2014 | Klasing et al. | |
| 8,845,280 | B2 | 9/2014 | Diamond et al. | |
| 8,851,833 | B2 | 10/2014 | Diamond et al. | |
| 8,944,774 | B2 * | 2/2015 | Bielek | F01D 5/145 416/236 A |
| 2007/0237627 | A1 | 10/2007 | Bunker | |
| 2009/0180887 | A1 | 7/2009 | Mischo et al. | |
| 2010/0054955 | A1 | 3/2010 | Helvaci et al. | |
| 2010/0098554 | A1 | 4/2010 | Cheong et al. | |
| 2010/0221122 | A1 | 9/2010 | Klasing et al. | |
| 2011/0255986 | A1 | 10/2011 | Diamond et al. | |
| 2011/0255990 | A1 | 10/2011 | Diamond et al. | |
| 2014/0119920 | A1 | 5/2014 | Coull et al. | |
| 2014/0119942 | A1 | 5/2014 | Lehmann et al. | |
| 2014/0241899 | A1 * | 8/2014 | Marini | F01D 5/20 416/236 R |
| 2015/0110617 | A1 * | 4/2015 | Stein | F01D 5/141 415/208.1 |
| 2015/0159488 | A1 | 6/2015 | Lehmann et al. | |

FOREIGN PATENT DOCUMENTS

| | | |
|---|---|---|
| DE | 695 15 442 T2 | 10/2000 |
| DE | 602 11 963 T2 | 1/2007 |
| EP | 1 898 052 A2 | 3/2008 |
| EP | 1 898 052 A3 | 7/2012 |
| GB | 793143 | 4/1958 |
| GB | 1 366 924 | 9/1974 |
| GB | 1 491 556 | 11/1977 |
| WO | WO 2005/106207 A1 | 11/2005 |

OTHER PUBLICATIONS

Nov. 19, 2013 Search Report issued in European Patent Application No. 13 19 0039.

British Search Report issued in Application No. 1219267.0; dated Feb. 21, 2013.

German Search Report issued in Application No. 10 2012 021 400.6; dated Apr. 29, 2013 (With Translation).

Apr. 5, 2016 Office Action issued in U.S. Appl. No. 14/061,971.

* cited by examiner

TURBINE BLADE WITH TIP OVERHANG ALONG SUCTION SIDE

FIELD OF THE INVENTION

The present invention relates to a blade of a turbine and preferably for a gas turbine engine, and in particular a structure of the tip of the blade.

BACKGROUND OF THE INVENTION

For turbine rotor blades and particularly high pressure (HP) turbine blades, there is an industry wide and ever-important objective to minimise both over-tip leakage (OTL) of hot working gases between a tip of the blades and a casing and heat transfer from the hot working gases to the blade. OTL occurs because of the pressure differential between a pressure-side and a suction-side of a turbine blade; this pressure differential can be referred to as 'driving pressure'.

In general, there are three types of tip geometry configurations which attempt to minimise over tip leakage: unshrouded, partially shrouded (or 'winglet') and fully shrouded. The simplest form of tip geometry is an unshrouded type having a flat tip (see FIG. 1). A flat tip design is typically associated with a relatively high aerodynamic loss due to the over-tip leakage flow and high heat transfer, although it is relatively simple to manufacture. Other configurations have been developed with the main intent to reduce the over-tip leakage flow and losses. One such type is called a 'squealer' (FIG. 2), which has pressure and suction walls sealed with a tip plate and ribs or fins extending from the tip plate to define a tip cavity. Another blade tip design is referred to as a 'winglet' (FIG. 3), which is effectively a partially shrouded blade and also has ribs or fins extending towards the casing.

Both the squealer and winglet designs form a tip cavity that serve to avoid losses in efficiency by reducing the amount of leakage flow passing over the tip and reducing the flow disturbances set up by the leakage flow. The gas that passes over a pressure side fin of the cavity forms a vortex in the cavity. Whereas these blade designs help to prevent over-tip leakage, they both require substantial amounts of cooling air. In particular, the over-tip leakage forms a vortex which impinges on the suction side of the blade causing significant heat transfer. The amount of cooling is largely determined by the heat load on the blades the hot mainstream gases.

The present invention therefore seeks to minimize over tip leakage and reduce heat load from the working gas into the blades.

SUMMARY OF THE INVENTION

A turbine blade has a root portion, a platform and an aerofoil, the aerofoil is mounted on the platform and is formed by a pressure side wall and a suction side wall and has an outer surface, the pressure side wall and the suction side wall meet at a leading edge and a trailing edge, the aerofoil has an axial chord length, the suction side wall defines part of the radially outward surface of the aerofoil, the suction side wall defines an overhang, the overhang has a maximum overhang length that is between 5% and 20% of the axial chord length of the blade and is located between 15% and 40% of the suction surface length from the leading edge and reduces in overhang length to zero at a position between 50% and 100% of the suction surface length from the leading edge.

The overhang may extend along the aerofoil a distance between 5% and 25% of the axial chord length from the outer surface.

The overhang may extend along the aerofoil a distance between 10% and 20% of the axial chord length from the outer surface.

The overhang may have a maximum overhang that is between 10% and 15% of the axial chord length of the blade.

The maximum overhang may be located between 25% and 40% of the suction surface length from the leading edge.

The overhang may reduce in overhang length from the maximum overhang length towards the leading edge and towards the trailing edge.

The overhang may reduce in overhang length to zero at a position between 50% and 100% of the suction surface length from the leading edge.

In another aspect of a rotor stage of a turbine comprising a rotational axis, a shroud and radially inward thereof a turbine blade in accordance with the above paragraphs, and a clearance gap which is defined from the radially outward surface to the shroud.

DETAILED DESCRIPTION OF THE INVENTION

Figure 4:
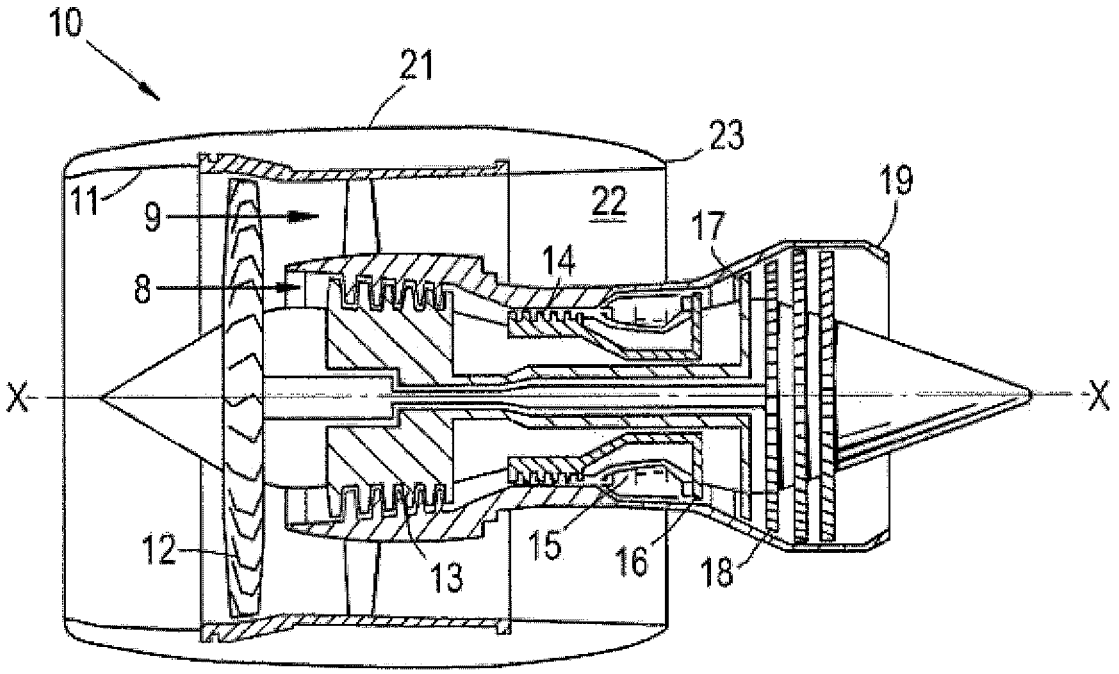
FIG. 4 is a schematic longitudinal cross-section through a ducted fan gas turbine engine in which the present invention is incorporated.

With reference to FIG. 4, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow 8 into the intermediate pressure compressor 13 and a second air flow 9 which passes through the bypass duct 22 to provide propulsive thrust. The intermediate pressure compressor 13 compresses the air flow 8 directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The performance of gas turbine engines, whether measured in terms of efficiency or specific output, is improved by increasing the turbine gas temperature. It is therefore desirable to operate the turbines at the highest possible temperatures. For any engine cycle compression ratio or bypass ratio, increasing the turbine entry gas temperature produces more specific thrust (e.g. engine thrust per unit of air mass flow). However as turbine entry temperatures increase, the life of an un-cooled turbine falls, necessitating the development of better materials and the introduction of internal air cooling.

In modern engines, the high-pressure turbine gas temperatures are hotter than the melting point of the material of the blades and vanes, necessitating internal air-cooling of these airfoil components. During its passage through the engine, the mean temperature of the gas stream decreases as power is extracted. Therefore, the need to cool the static and rotary parts of the engine structure decreases as the gas moves from the high-pressure stage(s), through the intermediate-pressure and low-pressure stages, and towards the exit nozzle.

Figure 5:
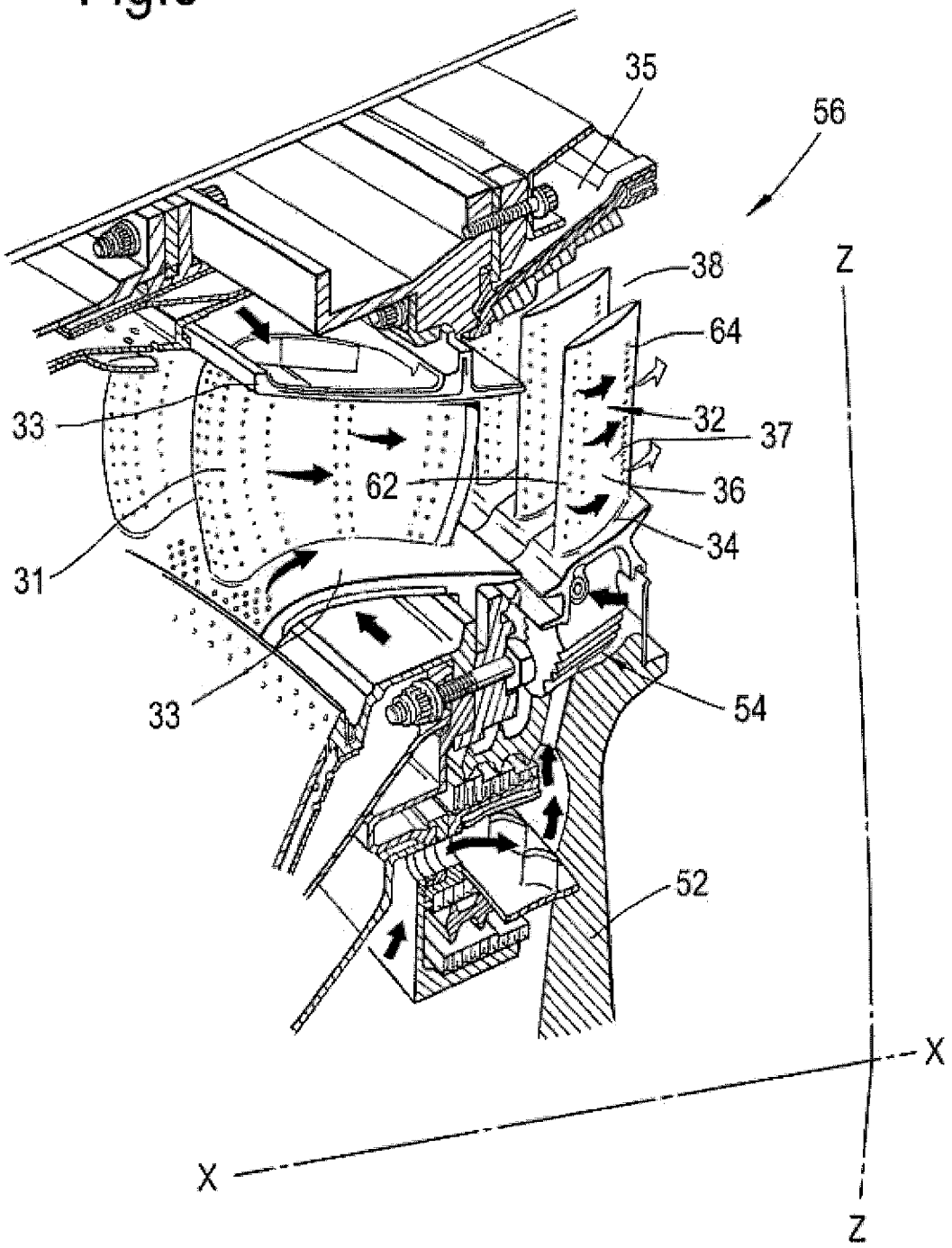
FIG. 5 is an isometric view of a typical single stage cooled turbine of the gas turbine described with reference to FIG. 4.

FIG. 5 shows an isometric view of a typical single stage cooled high-pressure turbine. Cooling air-flows are indicated by arrows.

Internal convection and external coolant films are the prime methods of cooling the gas path components—airfoils 36, platforms 34, shrouds 33 and casing shroud segments 35. High-pressure turbine nozzle guide vanes 31 (NGVs) consume the greatest amount of cooling air on high temperature engines. High-pressure blades 32 typically use about half of the NGV coolant flow. The intermediate-pressure and low-pressure stages downstream of the HP turbine use progressively less cooling air.

The high-pressure turbine airfoils are cooled by using high-pressure air from one of the compressors that has by-passed the combustor and is therefore relatively cool compared to the gas temperature. Typical cooling air temperatures are between 800 and 1000 K, while gas temperatures can be in excess of 2100 K.

The cooling air from the compressor that is used to cool the hot turbine components is not used fully to extract work from the turbine. Therefore, as extracting coolant flow has an adverse effect on the engine operating efficiency, it is important to use the cooling air effectively.

Ever increasing gas temperature levels combined with a drive towards flatter combustion radial temperature profiles, in the interests of reduced combustor emissions, have resulted in an increase in local gas temperature experienced by the extremities of the blades and vanes, and the working gas annulus endwalls.

Figure 7:
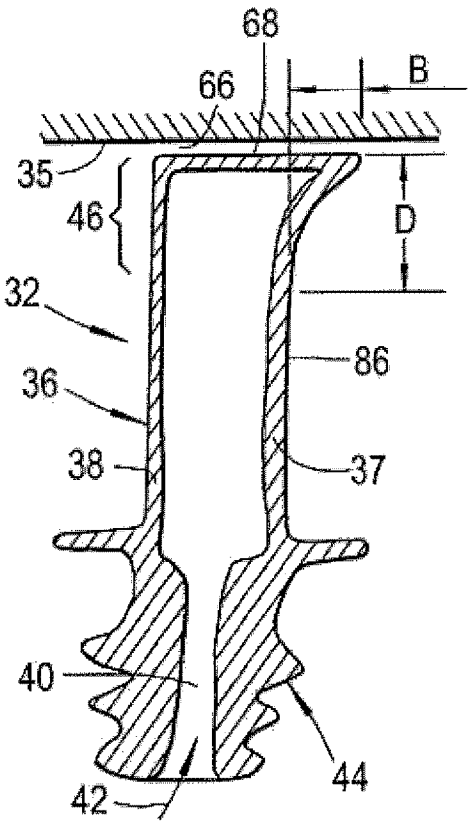
FIG. 7 is a schematic section E-E of the blade of FIG. 6.
Figure 6:
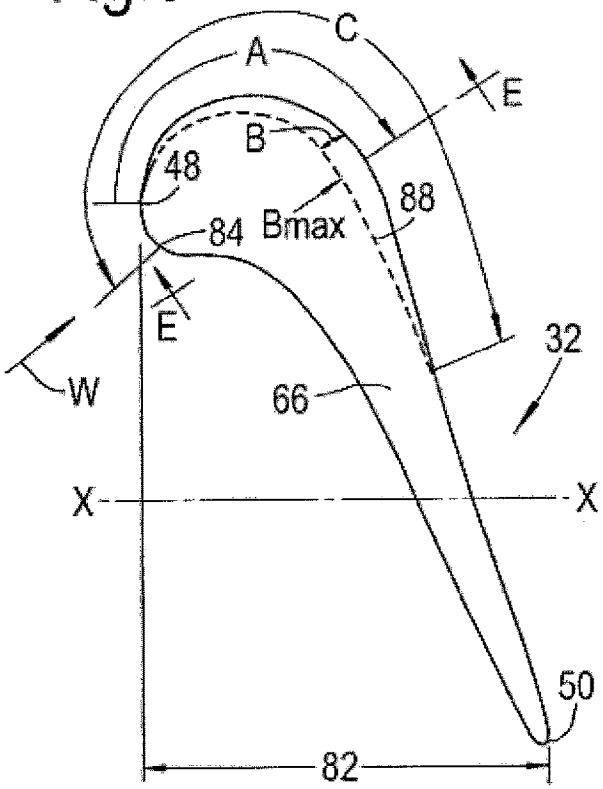
FIG. 6 is a schematic plan view of a tip of a blade in accordance with the present invention.

Referring to FIGS. 5, 6 and 7, a turbine blade 32 has a longitudinally extending aerofoil portion 36 with facing suction side 37 and pressure side 38 walls. The aerofoil portion 36 extends across the working gas annulus, with the longitudinal direction of the aerofoil portion being generally along a radial direction relative to the engine's rotational axis XX. The turbine blade 32 has a root portion 44 radially inward of the aerofoil and a tip portion 46 radially outward of the aerofoil. The suction side 37 and side 38 walls meet at a leading edge 48 and a trailing edge 50. The root portion engages a rotor disc 52 via complimentary dovetail or in this example, fir-tree fixtures 54. Radially outward of the tip portion 46 is the casing shroud 35. The blade, disc and casing shroud form a rotor stage 56.

A multi-pass cooling passage 38 is fed cooling air 42 by a feed passage 40 at a root of the blade. A second cooling air feed can supply additional coolant for the trailing edge of the blade. The trailing edge can be particularly prone to thermal erosion because it is relatively thin with a high surface area/volume and it is difficult to supply coolant. Cooling air leaves the multi-pass cooling passage through effusion holes 62, 64 in the aerofoil surfaces and particularly in the leading and trailing edges 48, 50 of the blade to create a film of cooling air over the surfaces 37, 38. The block arrows in FIG. 5 show the general direction of cooling air flow.

Radially outwardly of the turbine blade is a casing 35 often in the form of an annular array of shroud segments. The casing and a (radially) outer surface 68 of the blade tip define a gap or clearance 66. The casing may incorporate a tip clearance control arrangement capable of cooling or heating the shroud segment 35 to dilate or contract the shroud segments to maintain a desired position and gap relative to the blade tip. As is well known in the tip clearance control field cooling or heating fluid can be fed via holes to impinge onto the shroud segment.

Figure 11:
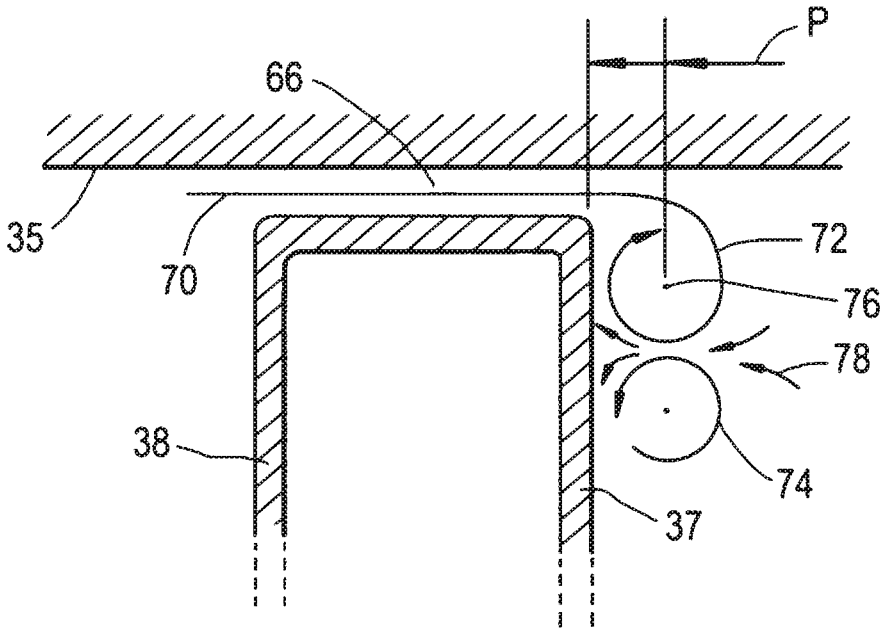
Fig. 11 Prior Art
FIG. 11 is an enlarged schematic section similar to section E-E in FIG. 6, but showing a conventional blade configuration.

FIG. 11 is an enlarged schematic section similar to section E-E in FIG. 6, but showing a conventional blade tip configuration. An over-tip leakage flow 70 leaves the gap 66 and forms an OTL vortex 72 immediately next to the suction side wall 37. The working gas passing between circumferentially adjacent blades forms at least one passage vortex 74 radially inward of the OTL vortex 72 and immediately next to the suction side wall 37. For descriptive purposes the OTL vortex 72 has a rotational centre-line 76 which is a distance P away from the suction side wall. The OTL vortex 72 causes a three-dimensional impingement on the suction side wall and imparts heat into the wall. In addition, the passage vortex 74 alone or in combination with the OTL vortex 72 entrains further hot gases 78 from the passage and which impinge against the suction side wall and imparts yet further heat into the wall. This undesirable heat transfer can be amplified by the two vortices counter rotating and drawing hot working gases in to impinge on the suction side wall. This phenomenon can occur along some, most or all of the suction side wall.

Figure 12:
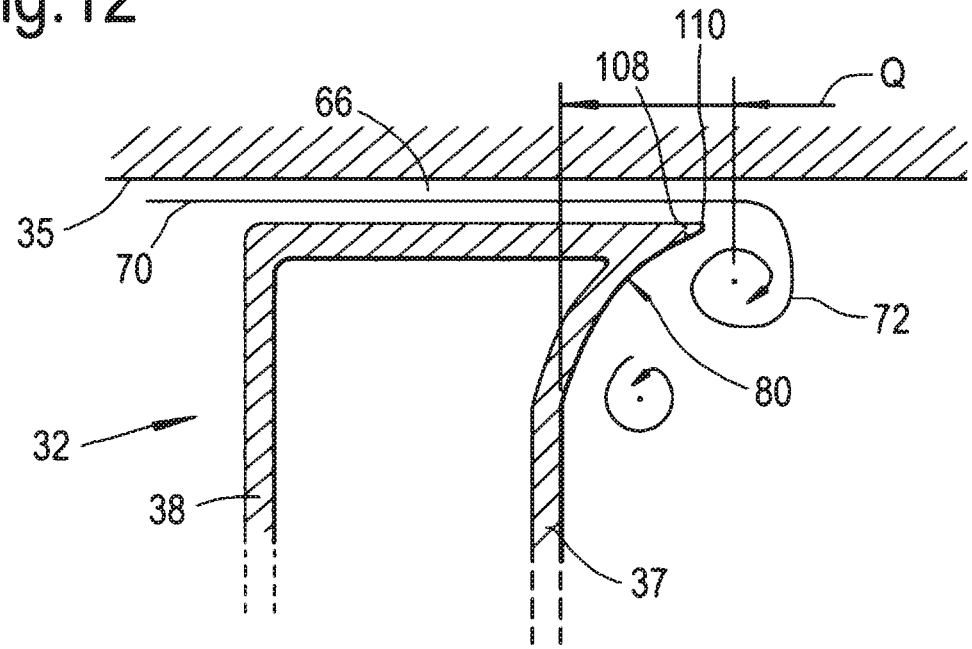
FIG. 12 is an enlarged schematic section E-E of the tip region of the blade of FIG. 6 in accordance with the present invention.

Referring to FIG. 12 which is an enlarged schematic section E-E of the tip region of the blade of FIG. 6. The blade 32 has an overhang 80 formed by the suction side wall. The configuration of the overhang 80 will be described in more detail later.

The configuration of the overhang 80 is advantageous because at and near to leading edge, the OTL flow around the leading edge portion of the blade tip is subsonic, so putting an overhang in this leading edge portion reduces the overall OTL driving pressure and hence reduces the leakage mass flow through the tip. The distance of the OTL vortex 72 is now further away from suction side wall can be controlled by the configuration of the overhang and in particular any one or more of the overhang's parameters including its chord-wise location, the depth of the overhang and the width of the bump. The overhang reduces the secondary flow losses in the blade passage and the heat transfer to the blade suction surface near the tip. Thus the OTL vortex 72 is now further away from the suction side wall, a distance Q which is greater than P.

The overhang is configured to exploit an OTL flow region in which the flow chokes as it flows over the tip. The leakage mass flow rate in this region is therefore largely insensitive to moderate changes in back-pressure, and so there is minimal aerodynamic benefit to be gained by having an overhang on the rear portion of the blade. This also reduces the heat loading to the blade through a combination of reduced surface area exposed to hot gases and increased acceleration of OTL flow in the tip gap 66.

Referring again to FIGS. 6 and 7 the configuration of the overhang 80 is now described in more detail. The turbine blade 32 comprises the root portion 44, the platform 34 and the aerofoil 36. The aerofoil is mounted on the platform and is formed by the pressure side wall 38 and the suction side wall 37. The aerofoil extends radially outwardly towards the casing 35 and has a radially outer surface 66 which faces the casing. The casing 35 and the radially outer surface 66 define the gap 66.

The pressure side wall 38 and the suction side wall 37 meet at nominal leading and trailing edges 48, 50. The nominal leading and trailing edges 48, 50 are the axially forward most part of the blade and the axially rearward most part of the blade. From a functional aspect, the pressure side wall 38 and the suction side wall 37 meet at a stagnation line 84. The stagnation line 84 is the position at which the working gas separates and travels either along the pressure or suction surfaces. However, the stagnation line can fluctuate in position relative to the geometric leading edge depending on radial height, engine power and specific blade design.

The aerofoil has an axial chord length 82, which is defined as the axial distance from the geometric leading edge 48 to the geometric trailing edge 50.

The suction side wall 37 defines part of the radially outer surface 68 of the aerofoil and the pressure side wall 38 can define the remainder of the radially outward surface 68.

The suction side wall 37 is continuous from the platform 34 to the outer surface 68 and includes the overhang 80. Thus the suction side surface 83 is also continuous from at least the platform 34 to the radially outer surface 68. The suction side wall 37 curves outwardly from the main part of the aerofoil into the overhang. The dotted line 88 defines the main part of the aerofoil immediately and radially inward of the overhang and as the suction surface begins to blend into the overhang.

The overhang 80 has a length B and a maximum overhang length $B_{max}$ that is between 5% and 20% of the axial chord length 82 of the blade. It has been found for certain blades that the maximum overhang $B_{max}$ that is between 10% and 15% of the axial chord length is particularly effective. The maximum overhang length $B_{max}$ is located a distance A that is between 5% and 50% of the suction surface length from the (geometric) leading edge 48. It has been found for certain blades that the maximum overhang length $B_{max}$ is located between 15% and 40% of the suction surface length from the leading edge, which is particularly effective.

In this example, the overhang 80 extends along (radially inwardly) the aerofoil a distance D (or depth) between 5% and 25% of the axial chord length 82 from the outer surface 68. It has been found for certain blades that the overhang extends along the aerofoil a distance between 10% and 20% of the axial chord length from the outer surface for a particularly effective response.

The overhang 80 reduces in overhang length B from the maximum overhang length $B_{max}$ position towards the leading edge and towards the trailing edge. In the FIG. 6 example, the overhang reduces in overhang length to zero at a position between 50% and 100% of the suction surface length from the leading edge.

Figure 1:
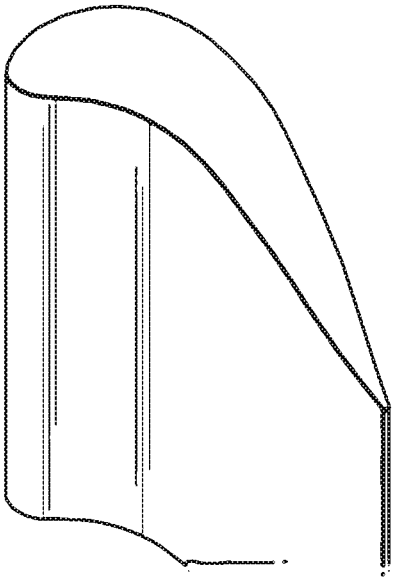
Fig. 1 Prior Art
FIG. 1 is a view on the pressure-side of a tip portion of a known turbine blade having a flat tip surface.
Figure 2:
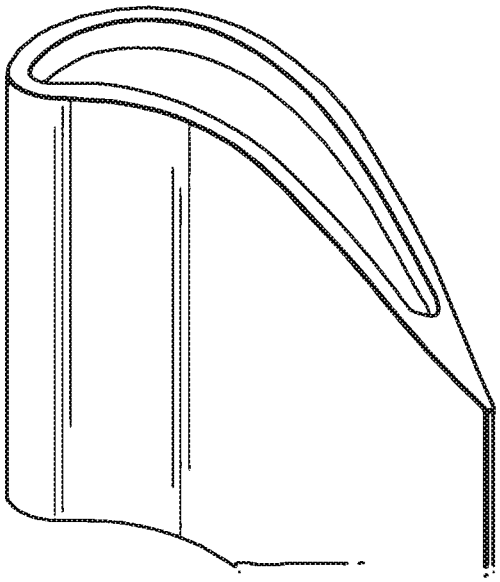
Fig. 2 Prior Art
FIG. 2 is a view on the pressure-side of a tip portion of a known turbine blade having a squealer tip configuration.
Figure 3:
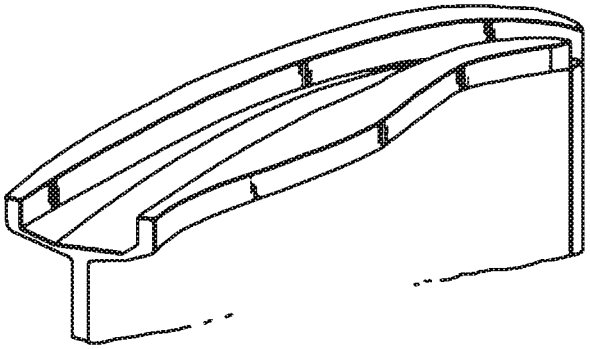
Fig. 3 Prior Art
FIG. 3 is a view on the suction-side of a tip portion of a known turbine blade having a winglet tip configuration.

The maximum overhang length is located in the region where the OTL flow exiting the tip gap starts to roll into and form the OTL vortex. The overhang moves the tip gap exit away from the blade suction surface in this region and therefore causes the OTL vortex to displace away from the blade suction surface. The aerodynamic influence of the overhang in the leading edge region also reduces the size of the upper passage vortex and hence its subsequent interaction with the OTL vortex. Together these two effects reduce the impingement of hot gas onto the blade surface. This mechanism reduces the overall blade heat load despite the increase in surface area of the blade compared to unshrouded blade having a flat tip as shown in FIG. 1.

The presently described overhang also causes mixing of the OTL flow to occur further towards the pressure surface of the circumferentially adjacent blade. The aerodynamic loss caused by the mixing process is proportional to the cube of the velocity at which is occurs. Moving the OTL vortex towards the pressure surface of the adjacent blade exploits the cross passage velocity (pressure) gradient so that the OTL mixing occurs at a lower velocity, with reduced aerodynamic loss.

In both cases, the influence of the overhang on the structure of the vortices diminishes further towards the trailing edge of the blade. As such, the present blade overhang with its location of the maximum overhang length, the size and chordal extent of the overhang advantageously improves aerodynamic efficiency and reduces heat load for a given blade.

Figure 8:
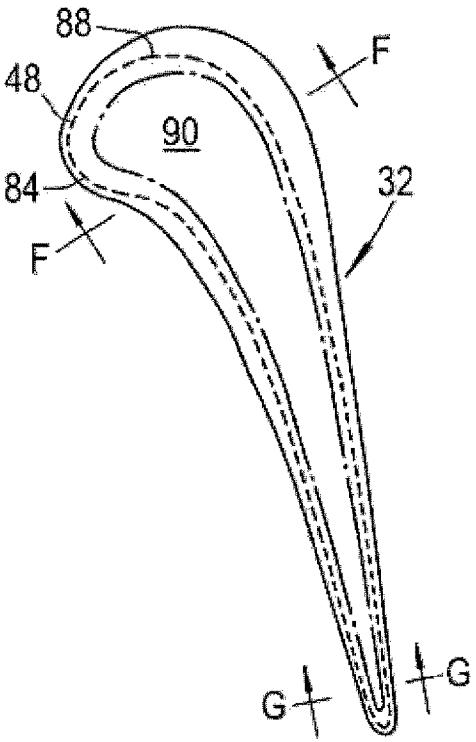
FIG. 8 is a schematic plan view of alternative configurations of a tip of a blade in accordance with the present invention.
Figure 9:
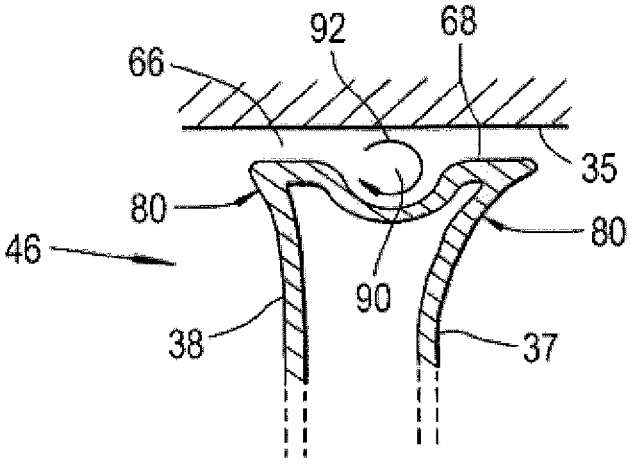
FIG. 9 is a schematic section F-F of the blade of FIG. 8.
Figure 10:
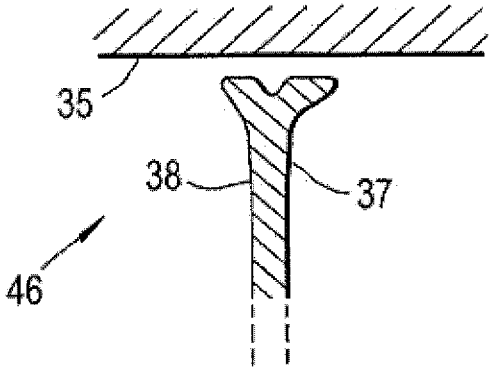
FIG. 10 is a schematic section G-G of the blade of FIG. 8.

FIGS. 8, 9 and 10 show alternative configurations of a tip of a blade in accordance with the present invention. In this example, the overhang 80 is continuous around the leading edge 48 and extends around a part of the pressure side wall. The radially outer surface 68 defines a cavity 90. The cavity 90 can cause a tip vortex 92 to occur. The tip vortex 92 can help prevent over tip leakage. Only one cavity is shown however, more than one cavity can be formed in the radially outer surface 68.

The cavity 92 further improves the sealing over the tip and also protects the floor of the cavity from the hot gases, thereby reducing the heat transfer into the blade and hence reducing cooling requirements.

Figure 13:
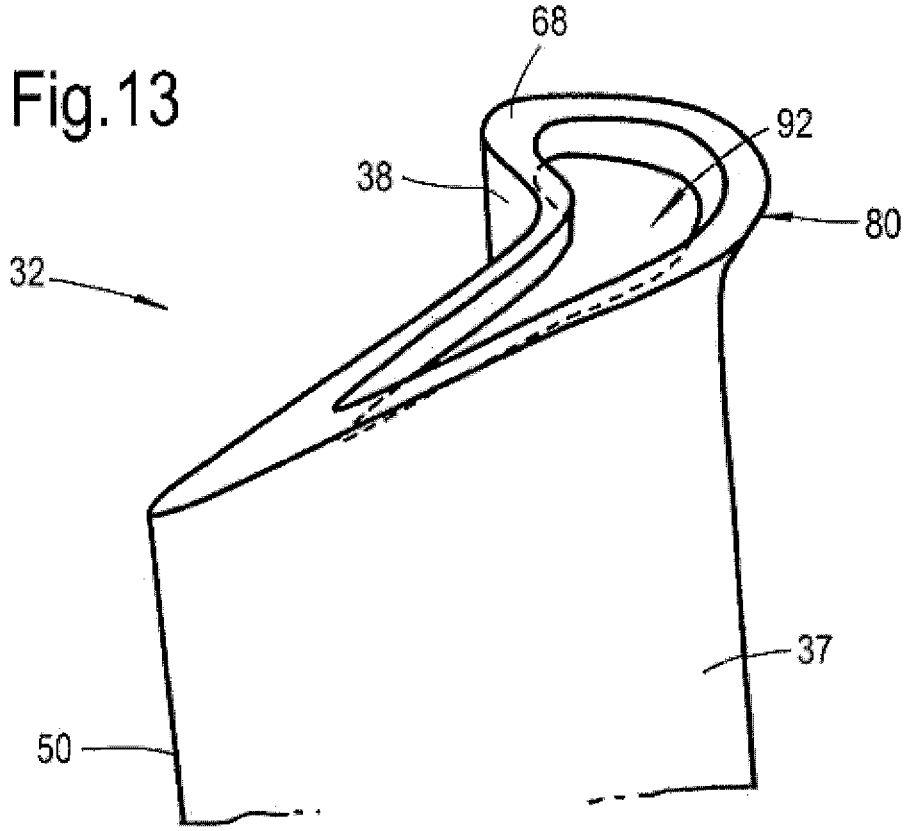
FIGS. 13-17 are views of a number of different embodiments of a tip region of a blade in accordance with the present invention.

FIG. 13 is an axially forward view of the tip of the blade 32 having a cavity 92 completely bounded by the pressure and suction side walls 38, 37.

Figure 14:
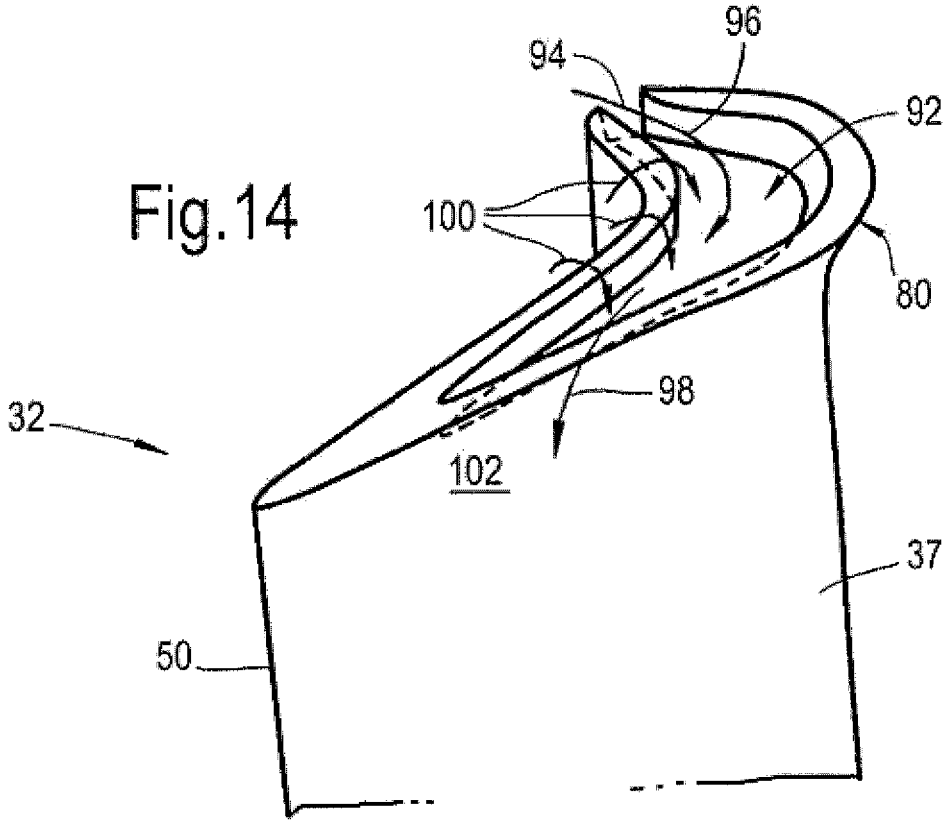

FIG. 14 is an axially forward looking view of the tip of the blade 32 having a cavity 92 bounded by the pressure and suction side walls 38, 37. At the leading edge region an opening 94 is formed. The opening 94 can be positioned close to the geometric leading edge 48 or the stagnation line 84. The opening 94 allows a portion 96 of the working gas into the cavity 92 which forces the OTL leakage flow 100 to exit the cavity at a rearward part 102 of the blade as shown by arrow 98.

Figure 15:
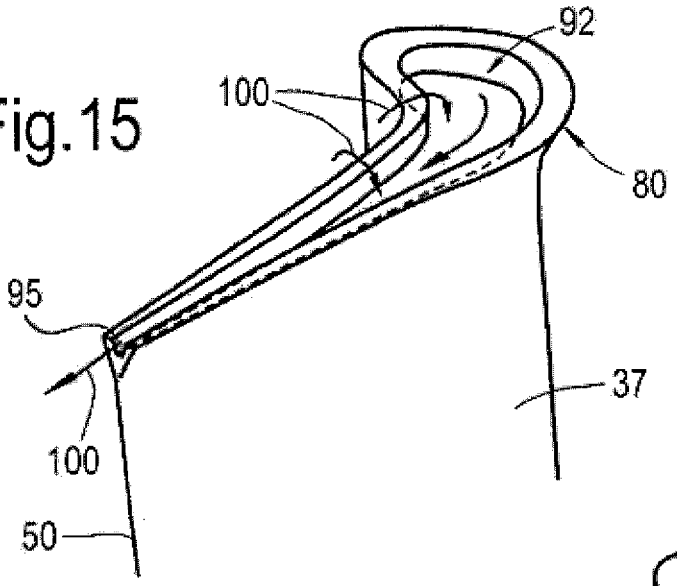

FIG. 15 is an axially forward looking view of the tip of the blade 32 having a cavity 92 bounded by the pressure and suction side walls 38, 37. At the trailing edge region an opening 95 is formed. The opening 95 allows the OTL gas flow 100 to exit the cavity rather than spilling over onto the suction side wall.

Figure 16:
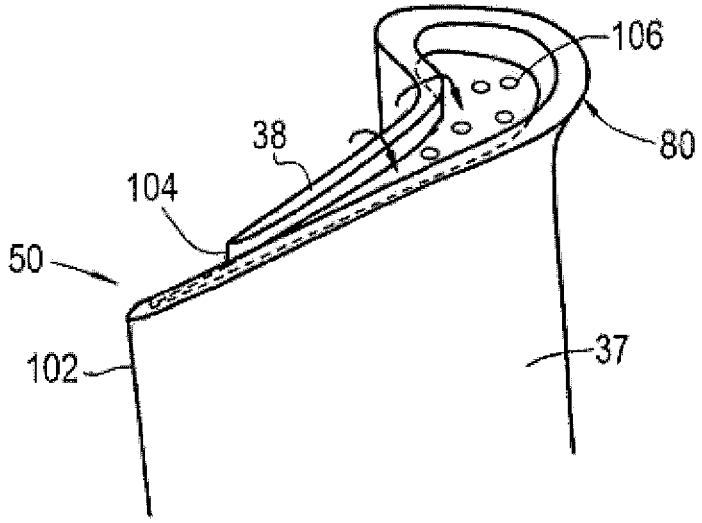

FIG. 16 is an axially forward looking view of the tip of the blade 32 having a cavity 92 bounded by the pressure and suction side walls 38, 37. At the trailing edge region an opening 95 is formed by curtailing the pressure side wall 38 short (104) of the trailing edge 102 of the suction side wall. Internal coolant can be channeled to egress the blade interior and form a coolant film of the now exposed inner wall of the suction surface wall to protect the trailing edge of the blade. Coolant may also be exhausted through an array of cooling holes 106 in the cavity 92, thus cooling the OTL flow. The opening 95 allows the OTL gas flow 100 to exit the cavity rather than spilling over onto the suction side wall.

Figure 17:
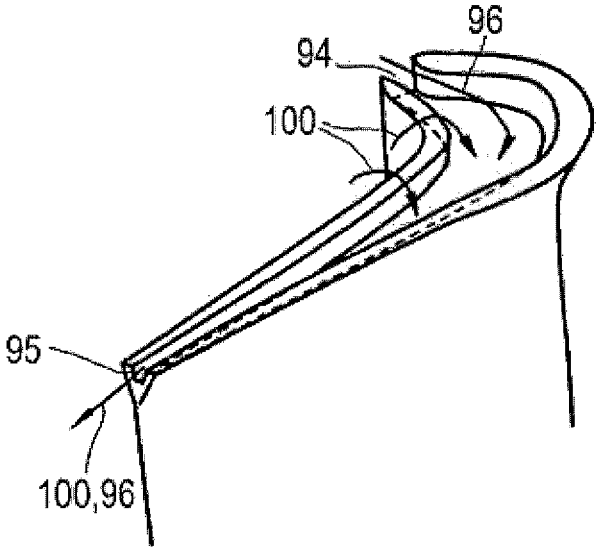

FIG. 17 is an axially forward looking view of the tip of the blade 32 having a cavity 92 bounded by the pressure and suction side walls 38, 37. The cavity has openings 94, 95 at the leading and trailing edge regions and similar to those described with reference to FIGS. 14 and 15. Again the objective of the openings is to force the over tip leakage rearwardly and prevent the over tip leakage from spilling over on to the suction surface.

It will be appreciated that the overhang 80 may change in depth D as its overhang width B changes. The overhang may be defined by a constant radius or other compound curve. The overhang may include a straight section 108 defining part or all of the free edge of the overhang; alternatively the free edge may be defined by a radius 110. The straight section 108 or radius 110 extends between the suction side wall surface 86 and the outer surface 68. Aerofoil surfaces are complex geometric three-dimensional shapes and it is intended that the suction and pressure surfaces smoothly blend or transition into the overhang.

The presently described turbine blade can be any one of a high pressure, intermediate pressure or low pressure turbine and equally applicable to an aero, marine or industrial turbine engine whether a gas or steam turbine engine. The presently described turbine blade can be any one of an engine having one, two or three spools.

Although the presently described turbine blade is described with reference to including a multi-pass cooling passage 38 common in metallic components any form of cooling arrangement may be present and indeed no cooling arrangement need be present. The presently described turbine blade can be formed of metal, ceramic or a composite material.

The invention claimed is:

1. A turbine blade comprising a root portion, a platform and an aerofoil, wherein:

the aerofoil is mounted on the platform and is formed by a pressure side wall and a suction side wall and has an outer surface, the pressure side wall and the suction side wall meet at a leading edge and a trailing edge, the aerofoil has an aerofoil tip and an axial chord length, the suction side wall defines an overhang at the aerofoil tip, the overhang has a maximum overhang length that is between 5% and 20% of the axial chord length of the blade and is located between 15% and 40% of the suction surface length from the leading edge, and the overhang reduces in overhang length from the maximum overhang length towards the trailing edge until the overhang length reaches zero at a position between 50% and 100% of the suction surface length from the leading edge.

2. The turbine blade as claimed in claim 1, wherein the overhang extends radially along the aerofoil a distance between 5% and 25% of the axial chord length from a radially outer surface of the aerofoil tip.

3. The turbine blade as claimed in claim 1, wherein the overhang extends radially along the aerofoil a distance between 10% and 20% of the axial chord length from a radially outer surface of the aerofoil tip.

4. The turbine blade as claimed in claim 1, wherein the maximum overhang length is between 10% and 15% of the axial chord length of the blade.

5. The turbine blade as claimed in claim 1, wherein the overhang reduces in overhang length from the maximum overhang length towards the leading edge and towards the trailing edge.

6. A rotor stage of a turbine comprising:

a rotational axis;

shroud;

the turbine blade as claimed in claim 1 radially inward of the shroud; and a clearance gap which is defined from a radially outward surface of the aerofoil tip to the shroud.

* * * * *